US008624503B2

(12) United States Patent
Jewell-Larsen et al.

(10) Patent No.: US 8,624,503 B2
(45) Date of Patent: Jan. 7, 2014

(54) COLLECTOR-RADIATOR STRUCTURE FOR AN ELECTROHYDRODYNAMIC COOLING SYSTEM

(75) Inventors: Nels Jewell-Larsen, Campbell, CA (US); Yan Zhang, San Jose, CA (US); Matt Schwiebert, San Jose, CA (US); Ken Honer, Santa Clara, CA (US)

(73) Assignee: Panasonic Precision Devices Co., Ltd. (JP)

( * ) Notice: Subject to any disclaimer, the term of this patent is extended or adjusted under 35 U.S.C. 154(b) by 607 days.

(21) Appl. No.: 12/772,008

(22) Filed: Apr. 30, 2010

(65) Prior Publication Data

US 2011/0139408 A1 Jun. 16, 2011

Related U.S. Application Data

(60) Provisional application No. 61/285,232, filed on Dec. 10, 2009.

(51) Int. Cl.
*H01J 7/24* (2006.01)

(52) U.S. Cl.
USPC ..... 315/111.91; 315/111.21

(58) Field of Classification Search
USPC ..... 315/39.59, 39.63, 111.01, 11.21, 315/111.31, 111.61–111.91, 500, 505–507
See application file for complete search history.

(56) References Cited

U.S. PATENT DOCUMENTS

| | | | | |
|---|---|---|---|---|
| 6,888,314 | B2 * | 5/2005 | Krichtafovitch et al. | 315/111.91 |
| 7,157,704 | B2 * | 1/2007 | Krichtafovitch et al. | 250/324 |
| 2006/0005946 | A1 | 1/2006 | Borgstrom | |
| 2008/0197779 | A1 | 8/2008 | Fisher | |
| 2008/0302514 | A1 | 12/2008 | Ouyang | |

* cited by examiner

*Primary Examiner* — Jimmy Vu

(57) ABSTRACT

An electrohydrodynamic fluid accelerator includes an emitter electrode and leading surfaces of a collector electrode that are substantially exposed to ion bombardment. Heat transfer surfaces downstream of the emitter electrode along a fluid flow path include a first portion not substantially exposed to the ion bombardment that is conditioned with a first ozone reducing material. The leading surfaces of the collector electrode are not conditioned with the first ozone reducing material, but may include a different surface conditioning. The downstream heat transfer surfaces and the leading surfaces can be separately formed and joined to form the unitary structure or can be integrally formed. The electrohydrodynamic fluid accelerator can be used in a thermal management assembly of an electronic device with a heat dissipating device thermally coupled to the conditioned heat transfer surfaces.

26 Claims, 9 Drawing Sheets

COLLECTOR-RADIATOR STRUCTURE FOR AN ELECTROHYDRODYNAMIC COOLING SYSTEM

CROSS-REFERENCE TO RELATED APPLICATION(S)

The present application claims the benefit of U.S. Provisional Application No. 61/285,232, filed Dec. 10, 2009, which is incorporated herein in its entirety by reference.

BACKGROUND

1. Field

The present application relates to thermal management, and more particularly, to micro-scale cooling devices that use electrohydrodynamic (EHD, also known as electro-fluid-dynamic, EFD) technology to generate ions and electrical fields to control the movement of fluids, such as air, as part of a thermal management solution to dissipate heat.

2. Related Art

Devices built using the principle of the ionic movement of a fluid are variously referred to in the literature as ionic wind machines, electric wind machines, corona wind pumps, electro-fluid-dynamics (EFD) devices, electrohydrodynamic (EHD) thrusters and EHD gas pumps. Some aspects of the technology have also been exploited in devices referred to as electrostatic air cleaners or electrostatic precipitators.

In general, electrohydrodynamic (EHD) technology uses ion flow principles to move fluids (e.g., air molecules). Basic principles of EHD fluid flow are reasonably well understood by persons of skill in the art. Accordingly, a brief illustration of ion flow using corona discharge principles in a simple two electrode system sets the stage for the more detailed description that follows.

With reference to the illustration in FIG. 1, corona discharge principles include applying a high intensity electric field between a first electrode 10 (often termed the "corona electrode," the "corona discharge electrode," the "emitter electrode" or just the "emitter") and a second electrode 12. Fluid molecules, such as surrounding air molecules, near the corona discharge region 11 become ionized and form a stream 14 of ions 16 that accelerate toward second electrode 12, colliding with neutral fluid molecules 22. During these collisions, momentum is imparted from the stream 14 of ions 16 to the neutral fluid molecules 22, inducing a corresponding movement of fluid molecules 22 in a desired fluid flow direction, denoted by arrow 13, toward second electrode 12. Second electrode 12 may be variously referred to as the "accelerating", "attracting", "collector" or "target" electrode. While stream 14 of ions 16 are attracted to, and neutralized by, second electrode 12, neutral fluid molecules 22 move past second electrode 12 at a certain velocity. The movement of fluid produced by corona discharge principles has been variously referred to as "electric," "corona" or "ionic" wind and has been defined as the movement of gas induced by the movement of ions from the vicinity of a high voltage discharge electrode 10.

Ozone ($O_3$), while naturally occurring, can also be produced by operation of various electronics devices, including EHD devices, photocopiers, laser printers and electrostatic air cleaners, and by certain kinds of electric motors and generators, etc. However, because ozone can be a respiratory irritant and has, particularly at high concentrations, been associated with certain health issues, ozone emission can be subject to strict regulatory limits such as those set by the Underwriters Laboratories (UL) or the Environmental Protection Agency (EPA). Accordingly, techniques to reduce ozone concentrations have been developed and deployed to catalytically or reactively break down ozone ($O_3$) into the more stable diatomic molecular form ($O_2$) of oxygen.

Improved ozone reduction techniques, and such techniques particularly adapted to EHD devices and deployments are desired.

SUMMARY

It has been discovered that ozone may be broken down or otherwise reduced or sequestered in EHD systems by selective provision of ozone reducing materials on system surfaces. For example, manganese dioxide ($MnO_2$) is commonly used as a catalyst material for ozone destruction. However, it has been found that at least certain $MnO_2$-based surface coatings and, particularly, organic binders commonly used therein may not be particularly well adapted for surfaces that collect a significant amount of ion current. Indeed, surface coatings such as those marketed under BASF PremAir™ brand of $MnO_2$ ozone catalysts may be ill-suited for use on leading surfaces of collector electrodes due to coating roughness, breakdown of the organic binder of the coating over time from ion bombardment and exposure to ozone, and because of resulting field instability and dust adhesion. That said, $MnO_2$-based surface coatings often can function well on areas of the collector or radiator that do not collect a significant ion current or are not otherwise subject to significant ion bombardment.

In general, a primary function of collector electrodes in EHD devices is to direct and capture the ion current generated by an emitter electrode, e.g., as a corona discharge or by some other mechanism. The surfaces of the collector electrode generally have an electrical resistance low enough to collect the charge from the ion current. In addition, leading surfaces of collector electrodes can have a smooth surface that is generally resistant to oxidation over time and robust despite ion bombardment and occasional arcing to its surface, such that the surface maintains a smooth electric field. In some embodiments, the surface is hard enough to allow for periodic removal of dust debris by frictional contact.

A primary function of a radiator or heat sink (and its constituent heat transfer surfaces) is to efficiently transfer heat to the air flowing through or over it. Implementations of radiators or heat sinks often provide a large surface area in contact with the flow to accomplish this. The radiator should have a sufficiently high thermal conductivity, large surface area (e.g., an array of thin fins) and should allow for efficient conduction of heat to and off of its surface. Provision of ozone reducing materials, be they catalytic or reactive, on heat transfer surfaces can provide desirable reductions in ozone levels.

It has been discovered that in structures in which a collector electrode of an EHD air mover is integrated with a radiator or heat sink of a thermal system, the collector and radiator surfaces may be selectively conditioned to optimize ozone destruction in the air moving there through and to provide robust operation of the EHD cooling system. For example, surface properties of the collector electrode and radiator present different performance requirements, and as such, surface conditioning for ozone destruction may be different in regions that collect a significant ion current and those that do not. By adapting structures, materials, surface conditioning treatments and methods for achieving the needs or demands of specific regions, embodiments may provide for longer operational lifetimes, improved performance, and/or reduced ozone emission.

In the present application, some embodiments of the devices illustrated and described herein are referred to as electrohydrodynamic fluid accelerator devices, also referred to as "EHD devices," "EHD fluid accelerators," and the like. Such devices are suitable for use as a component in a thermal management solution to dissipate heat generated by an electronic circuit, amongst other things. For concreteness, some embodiments are described relative to particular EHD device configurations in which a corona discharge at or proximate to an emitter electrode operates to generate ions that are accelerated in the presence of electrical fields, thereby motivating fluid flow. While corona discharge-type devices provide a useful descriptive context, it will be understood (based on the present description) that other ion generation techniques may also be employed. For example, in some embodiments, techniques such as silent discharge, AC discharge, dielectric barrier discharge (DBD) or the like may be to generate ions that are in turn accelerated in the presence of electrical fields and motivate fluid flow.

Based on the description herein, persons of ordinary skill in the art will appreciate that selective provision of ozone reducing materials on particular systems surfaces may likewise benefit systems that employ other ion generation techniques to motivate fluid flow. For example, a DBD system that provides electrical discharge between two electrodes separated by an insulating dielectric barrier may generate ozone, which may be addressed using techniques described herein. Thus, in the claims that follow, the terms "emitter electrode" and "electrohydrodynamic fluid accelerator" are meant to encompass a broad range of devices without regard to the particular ion generation techniques employed.

In some embodiments, an electrohydrodynamic fluid accelerator includes an emitter electrode and leading surfaces of a collector electrode energizable to generate ions and to thereby motivate fluid flow along a flow path. The leading surfaces are substantially exposed to ion bombardment. Heat transfer surfaces are positioned downstream of the emitter electrode along the flow path and include at least a first portion not substantially exposed to the ion bombardment. The first portion of the heat transfer surfaces is conditioned with a first ozone reducing material while the leading surfaces are not conditioned with the first ozone reducing material.

In some embodiments, the leading surfaces are conditioned with a second ozone reducing material, different from the first.

In some embodiments, the emitter electrode and leading surfaces of the collector electrode are energizable to establish a corona discharge therebetween; and the ion bombardment results from the corona discharge.

In some cases, the leading surfaces are resistant to the ion-bombardment and occasional arcing from the emitter electrode and robust to frictional cleaning.

In some cases, the leading surfaces include a surface coating that is non-oxidizing at least in the presence of the motivated fluid. The surface coating can be formed in some cases as one or more of an electroplate on an injection-molded UL94-V0 compliant thermoplastic; an electroplate on die-cast zinc (Zn) or zinc alloy; an electroplate on powder injection-molded metal; and an electroplate, anodization or alodization on die-cast aluminum (Al), aluminum alloy or magnesium (Mg) alloy.

In some cases, the electroplate is formed as one or more of: gold (Au) over nickel (Ni); NiPd over Ni; silver (Ag); silver oxide ($Ag_2O$); an oxide of manganese; an ozone catalyst; and an ozone reactive material.

In some implementations, the downstream heat transfer surfaces and the leading surfaces are constituent surfaces of a unitary structure that functions both as the collector electrode and as a heat sink. In some cases, the first ozone reducing material, if any, has been removed from the leading surfaces. In some cases, deposition, if any, of the first ozone reducing material has been masked from leading surfaces.

In some implementations, the downstream heat transfer surfaces and the leading surfaces are separately formed, but joined to form the unitary structure. In some implementations, the heat transfer surfaces are distinct from the collector electrode, but proximate thereto in the flow path. In some cases, the collector electrode includes additional surfaces, other than the leading surfaces thereof, that are exposed to the fluid flow but not substantially exposed to the ion bombardment, and the additional surfaces of the collector electrode are also conditioned with the first ozone reducing material.

In some cases, the collector electrode, including the leading surfaces thereof, has a surface coating which is electrochemically robust to the ion-bombardment and to occasional arcing from the emitter electrode. In some cases, the electrochemically robust surface coating is further robust to frictional cleaning of the leading surfaces.

In some embodiments, the leading surfaces of the collector electrode are conditioned with a second ozone reducing material, different from the first. In some cases, the second ozone reducing material is selected from a group that includes: gold (Au); silver (Ag); silver oxide ($Ag_2O$); and an oxide of manganese preparation without an organic binder susceptible to degradation in electric fields and ion bombardment conditions typical of corona discharge operation.

In some embodiments, the first ozone reducing material is a catalyst selected from a group that includes: manganese dioxide ($MnO_2$); silver (Ag); silver oxide ($Ag_2O$); and an oxide of nickel (Ni).

In some implementations, an electrohydrodynamic fluid accelerator includes an emitter electrode and at least one collector electrode energizable to generate ions and to thereby motivate fluid flow along a flow path. The collector electrode is coupled into a heat transfer pathway to dissipate heat into the fluid flow, and includes both leading surfaces substantially exposed to ion bombardment and additional surfaces not substantially exposed to the ion bombardment. The additional surfaces, but not the leading surfaces, of the collector electrode are conditioned with a first ozone reducing material.

In some cases, the leading surfaces include a surface coating electro-chemically robust to the ion-bombardment and to occasional arcing from the emitter electrode.

In some implementations, the electrohydrodynamic fluid accelerator is configured to establish corona discharge between the emitter and collector when energized to thereby generate the ions.

In some implementations, an electrohydrodynamic fluid accelerator includes an emitter electrode and at least one collector electrode energizable to generate ions and to thereby motivate fluid flow along a flow path. The collector electrode includes leading surfaces substantially exposed to ion bombardment from the emitter electrode; and heat transfer surfaces, distinct from the collector electrode, but proximate therewith, the heat transfer surfaces downstream of the emitter electrode in the flow path but not substantially exposed to the ion bombardment. The heat transfer surfaces are conditioned with a first ozone reducing material while the leading surfaces of the collector electrode are not conditioned with the first ozone reducing material.

In some applications, a method of making a product includes conditioning heat transfer surfaces with an ozone reducing material and conditioning at least leading surfaces of a collector electrode with a surface that is electro-chemically robust to ion bombardment and arcing. The method further includes positioning the conditioned heat transfer surfaces downstream of, and proximate to, the collector electrode; and fixing an emitter electrode proximate to the conditioned leading surfaces of the collector electrode that, when energized, generates ions and thereby motivates fluid flow over the conditioned heat transfer surfaces. The emitter electrode, collector electrode and conditioned heat transfer surfaces are so positioned and fixed to constitute a thermal management assembly.

In some cases, the conditioning of the heat transfer surfaces includes one of dip coating, spray coating or electroplating an underlying structure with the ozone reducing material. In some cases, the conditioning of the leading surfaces of the collector electrode includes one of electroplating, anodizing or alodizing an underlying structure.

In some applications, the method includes introducing the thermal management assembly into an electronic device and thermally coupling a heat dissipating device thereof to the conditioned heat transfer surfaces.

In some applications, a method of making a product includes conditioning heat transfer surfaces of a collector electrode with an ozone reducing material and conditioning leading surfaces of the collector electrode to provide a surface that is substantially devoid of the ozone reducing material and which is electro-chemically robust to ion bombardment and arcing. The method further includes fixing an emitter electrode proximate to the leading surfaces of the collector electrode that, when energized, generates ions and thereby motivates fluid flow over the heat transfer surfaces. The emitter electrode and the collector electrode are so fixed to constitute at least a portion of a thermal management assembly.

In some applications, the conditioning of the heat transfer surfaces includes one of dip coating, spray coating or otherwise applying the ozone reducing material to an underlying structure; and the conditioning of the leading surfaces includes removing any of the ozone reducing material sprayed or applied thereon to reveal an electroplate, anodized or alodized surface electro-chemically robust to ion bombardment and arcing.

In some applications, the method further includes introducing the thermal management assembly into an electronic device and thermally coupling a heat dissipating device thereof to the conditioned heat transfer surfaces.

BRIEF DESCRIPTION OF THE DRAWINGS

The present invention may be better understood, and its numerous objects, features, and advantages made apparent to those skilled in the art by referencing the accompanying drawings.

The use of the same reference symbols in different drawings indicates similar or identical items.

DETAILED DESCRIPTION

Figure 1:
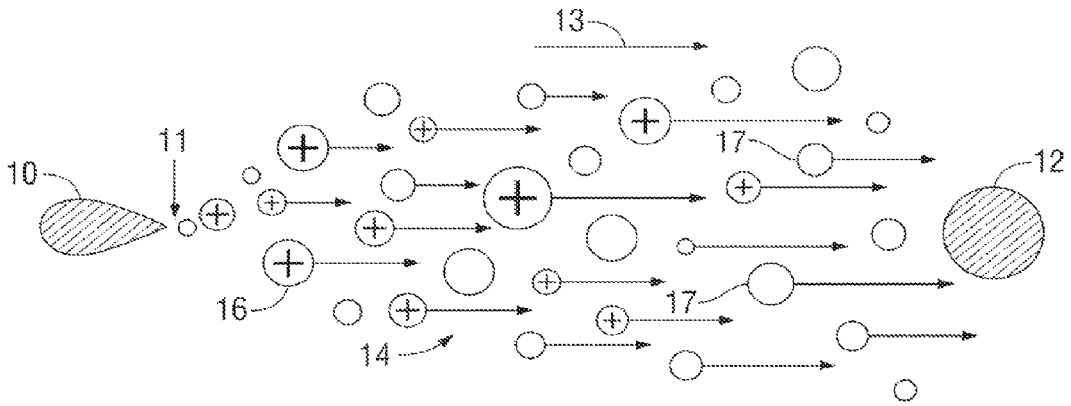
FIG. 1 (PRIOR ART)
FIG. 1 is a depiction of certain basic principles of electrohydrodynamic (EHD) fluid flow.

Some embodiments of thermal management systems described herein employ EHD devices to motivate flow of a fluid, typically air, based on acceleration of ions generated as a result of corona discharge. Other embodiments may employ other ion generation and motivation techniques and will nonetheless be understood in the descriptive context provided herein. For example, in some embodiments, techniques such as silent discharge, AC discharge, dielectric barrier discharge (DBD) or the like may be to generate ions that are in turn accelerated in the presence of electrical fields to motivate fluid flow.

Using heat transfer surfaces that may or may not be monolithic or integrated with collector electrodes, heat dissipated by electronics (e.g., microprocessors, graphics units, etc.) and/or other components can be transferred to the fluid flow and exhausted. Typically, when a thermal management system is integrated into an operational environment, heat transfer paths (often implemented as heat pipes or using other technologies) are provided to transfer heat from where it is dissipated (or generated) to a location (or locations) within the enclosure where air flow motivated by an EHD device (or devices) flows over heat transfer surfaces. Of course, while some embodiments may be fully integrated in an operational system such as a laptop or desktop computer, a projector or video display device, printer, photocopier, etc., other embodiments may take the form of subassemblies.

As described herein, heat transfer surfaces and at least leading surface portions of collector electrodes present differing design challenges and, relative to certain illustrative embodiments, may be provided with different surface conditioning. In some embodiments, a monolithic structure may act as a collector electrode and provide heat transfer surfaces. In some embodiments, collector electrodes and dominant heat transfer surfaces are provided (or at least fabricated) as separate structures that may be mated, integrated or more generally positioned proximate each other in operational configurations. These and other variations will be understood with reference to the described embodiments.

In general, a variety of scales, geometries and other design variations are envisioned for collector electrodes, together with a variety of positional interrelationships between emitter and collector electrodes of a given device. For concreteness of description, we focus on certain illustrative embodiments and certain illustrative surface profiles and positional interrelationships with other components. For example, in much of the description herein, plural planar collector electrodes are arranged in a parallel, spaced-apart array proximate to an emitter wire that is spaced from leading surfaces of the respective collector electrodes. In some embodiments, planar portions of the collector electrodes are oriented generally orthogonally to the longitudinal extent of an emitter wire. In other embodiments, orientation of collector electrodes is such that leading surfaces thereof are generally parallel to the longitudinal extent of an emitter wire. In some embodiments, other corona discharge electrode configurations are provided.

In some embodiments, leading surfaces present a curved arrangement or profile to an emitter electrode (or electrodes). In some embodiments, leading surfaces present other (e.g., non-curved) arrangements or profiles to an emitter electrode (or electrodes). In some thermal management system embodiments, collector electrodes provide significant heat transfer to fluid flows motivated therethrough or thereover. In some thermal management system embodiments, heat transfer surfaces that do not participate substantially in EHD fluid acceleration may provide substantial, even dominant, heat transfer.

It will be understood that particular EHD design variations are included for purposes of illustration and, persons of ordinary skill in the art will appreciate a broad range of design variations consistent with the description herein. In some cases, and particularly in the illustration of flow paths, EHD designs are illustrated simply as a corona discharge electrode assembly and a collector electrode assembly proximate each other; nonetheless, such illustrations within the broad context of a full range of EHD design variations are described herein.

Although embodiments of the present invention are not limited thereto, much of the description herein is consistent with geometries, air flows, and heat transfer paths typical of laptop-type computer electronics and will be understood in view of that descriptive context. Of course, the described embodiments are merely illustrative and, notwithstanding the particular context in which any particular embodiment is introduced, persons of ordinary skill in the art having benefit of the present description will appreciate a wide range of design variations and exploitations for the developed techniques and configurations. Indeed, EHD device technologies present significant opportunities for adapting structures, geometries, scale, flow paths, controls and placement to meet thermal management challenges in a wide range of applications and systems. Moreover, reference to particular materials, dimensions, electrical field strengths, exciting voltages, currents and/or waveforms, packaging or form factors, thermal conditions, loads or heat transfer conditions and/or system designs or applications is merely illustrative. In view of the foregoing and without limitation on the range of designs encompassed within the scope of the appended claims, we now describe certain illustrative embodiments.

Electrohydrodynamic (EHD) Fluid Acceleration, Generally

Basic principles of electrohydrodynamic (EHD) fluid flow are well understood in the art and, in this regard, an article by Jewell-Larsen, N. et al., entitled "Modeling of corona-induced electrohydrodynamic flow with COMSOL multiphysics" (in the *Proceedings of the ESA Annual Meeting on Electrostatics* 2008) (hereafter, "the Jewell-Larsen Modeling article"), provides a useful summary. Likewise, U.S. Pat. No. 6,504,308, filed Oct. 14, 1999, naming Krichtafovitch et al. and entitled "Electrostatic Fluid Accelerator" describes certain electrode and high voltage power supply configurations useful in some EHD devices. U.S. Pat. No. 6,504,308, together with sections I (Introduction), II (Background), and III (Numerical Modeling) of the Jewell-Larsen Modeling article are hereby incorporated by reference herein for all that they teach.

Note that the simple illustration of corona-induced electrohydrodynamic fluid flow shown in FIG. 1 (which has been adapted from the Jewell-Larsen Modeling article and discussed above) includes shapes for first electrode 10 and second electrode 12 that are particular to the simple illustration thereof. Likewise, the electrode configurations illustrated in U.S. Pat. No. 6,504,308 and aspects of the power supply design are particular thereto. Accordingly, such illustrations, while generally useful for context, are not intended to limit the range of possible electrode or high voltage power supply designs in any particular embodiment of the present invention.

In general, emitter electrodes may be fabricated in a wide range of materials. For example, in some embodiments, compositions such as described in U.S. Pat. No. 7,157,704, filed Dec. 2, 2003, entitled "Corona Discharge Electrode and Method of Operating the Same" and naming Krichtafovitch et al. as inventors may be employed. U.S. Pat. No. 7,157,704 is incorporated herein for the limited purpose of describing materials for some emitter electrodes that may be employed in some embodiments. In general, a high voltage power supply creates the electric field between emitter electrodes and collector electrodes.

Conditioning of Surfaces in a Collector-Radiator Structure

As used herein, the terms "surface conditioning" and "conditioning materials" refer to any surface coating, surface deposit, surface alteration or other surface treatment suitable to provide ozone reduction, low surface adhesion, or other surface-specific performance or benefits described herein.

Figure 2A:
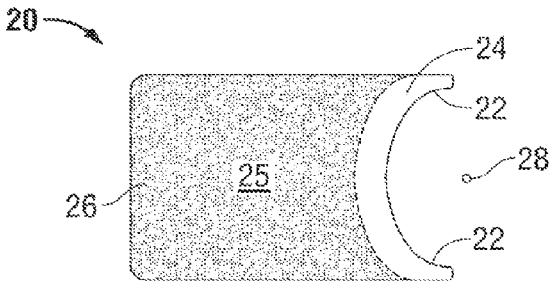
FIGS. 2A and 2B depict respective end-on and perspective views of an illustrative monolithic collector-radiator structure of an EHD fluid accelerator.
Figure 2B:
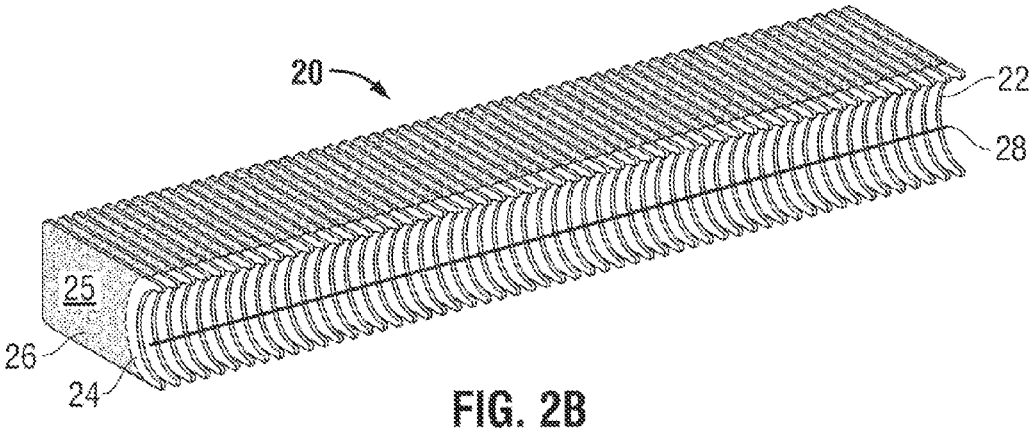
Figure 2C:
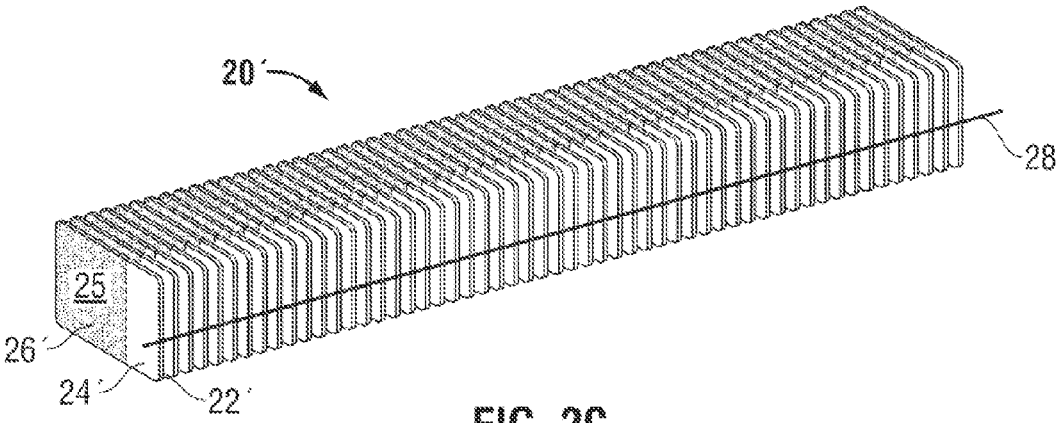
FIG. 2C depicts a perspective view of an alternative monolithic collector-radiator structure of an EHD fluid accelerator having an alternative leading surface profile.

Referring to FIGS. 2A-2C, some embodiments provide a collector-radiator structure 20, 20' with ozone destructive or ozone reducing materials, "surface conditioning" 25, on certain trailing portions or surfaces 26 while leading ion collection surfaces 24 are provided with an alternative surface conditioning, or lack thereof. References to leading or trailing are to be understood with directional reference to exposure to ion bombardment and fluid flow induced by electrode 28. Surfaces 26 in some embodiments may be referred to as radiator surfaces or non-collection surfaces.

Multiple discreet radiator-collector fins or components may be arranged in an array in collector-radiator structure 20, 20'. Surface conditioning 25 may be applied to surfaces 26 on opposite sides of individual fins within an array. In some cases, different types or compositions of surface conditioning 25 may be used on opposed or opposite surfaces 26. For example, an ozone reducing catalyst may be applied to one surface 26 and a different ozone reducing material applied to an opposing surface 26.

Differentiation of surface conditioning between discreet surfaces 26 or between surfaces 26 and 24 may be used to optimize or enhance efficacy of each of ion collection surfaces 24, 24' and those surfaces 26 that are exposed to fluid flow but may not substantially contribute to ion-collection. For example, selective conditioning of ion collection surfaces 24, 24' and surfaces 26 (for which ion collection is low, negligible or insignificant relative to material compatibility issues) can allow certain embodiments to maximize surface area of an effective ozone destructive surface to be used while reducing or limiting system (and in particular collector surface) sensitivity or susceptibility to dust accumulation, to adhesion or growth of other materials, to ion bombardment and/or to sparking.

In some embodiments, secondary, potentially less reactive or catalytic, ozone destructive materials can be used on ion collection surfaces 24, 24' to enhance or maximize the total ozone destruction in the system, while still accommodating design goals or constraints particular to the collector surfaces.

In some embodiments, leading edges 22 may be provided with still a different surface conditioning than surfaces 24 or 26.

In some embodiments in accordance with the present invention, for a collection surface 24, 24' that is not intended to be a significant heat transfer surface, a desirable surface conditioning 25 provides a hard, stable, non-oxidizing coating (surface) over die cast metal or UL-94V0 compliant injection moldable base material. In various embodiments, candidate base material and surface conditioning combinations can include one or more of the following: electroplated injection-molded UL94-V0 compliant thermoplastic such as mineral or glass filled ULTEM, ABS, PVC, ABS-PVC blend; electroplated die cast Zamak metal (Zn—Al alloys); electroplated, anodized or alodine coated die cast aluminum (A380 or equivalent alloy) or magnesium alloy; and electroplated powder injection molded metal.

In some embodiments, surface conditioning 25 includes electroplating coatings, for example, hard Au over Ni or NiPd over Ni over e-less Ni. In some embodiments, surface conditioning 25 includes surface treatments such as type III hard anodize or alodine treatments to aluminum base materials. In some embodiments, surface conditioning materials may include Ag, AgOx, Mn, MnOx or other ozone reactive materials. In some embodiments, combinations of base material surface treatment, e.g., electroplating or anodizing, and surface conditioning coatings including ozone reducing materials may be employed in surface conditioning 25. In some embodiments, conditioning of the heat transfer surfaces includes one of dip coating, spray coating or electroplating an underlying structure with an ozone reducing material.

In some embodiments in accordance with the present invention, for a non-collection surface 26, including e.g., surfaces of a radiator formed of highly thermally-conductive materials, surface conditioning 25 can include an ozone reducing material coating. Ozone reducing materials can include ozone catalysts, ozone binders, ozone reactants or other materials suitable to react with, bind to, or otherwise reduce or sequester ozone. Illustrative ozone reducing material surface conditioning 25 can include: catalyst coated copper alloy or aluminum alloy punched and stacked fins, catalyst coated die cast A380 aluminum alloy or magnesium, and catalyst coated extruded aluminum.

In some embodiments in which a monolithic collector-radiator structure 20, 20' may include both surfaces 24, 24' and 26, a surface conditioning 25, e.g., catalyst or coating applied to surface 26 or other surface treatment may be selectively removed or omitted from all or portions of collector surfaces 24, 24' such as leading collector edges/surfaces 22 facing an electrode 28, e.g., a corona discharge electrode. Absence of surface conditioning 25 on such surfaces 22, 24, 24' may be desirable for avoidance of arcing, dendrite formation, air flow disruption or other possible deleterious effects.

Various methods of selective provision and omission of surface conditioning 25 are described. In some applications, masking materials are applied to prevent collector surface 24, 24' from being coated with an ozone reducing material during coating of adjacent surface 26. Suitable masking processes can include slip urethane processes, use of removable or sacrificial coatings, e.g., silicone, or other suitable masking processes or materials. In some applications, surface conditioning may be selectively removed from surfaces 22, 24 via mechanical or chemical action, e.g., using abrasives or solvents. In some applications, two separate parts are mechanically joined to form collector-radiator after one part is coated. (See, e.g., FIGS. 6A-6C). Accordingly, various methods may be used to achieve selective application or removal of material or surface treatments from collector surfaces 22 or 24 or other regions where its presence of such may be undesirable.

Figure 3A:
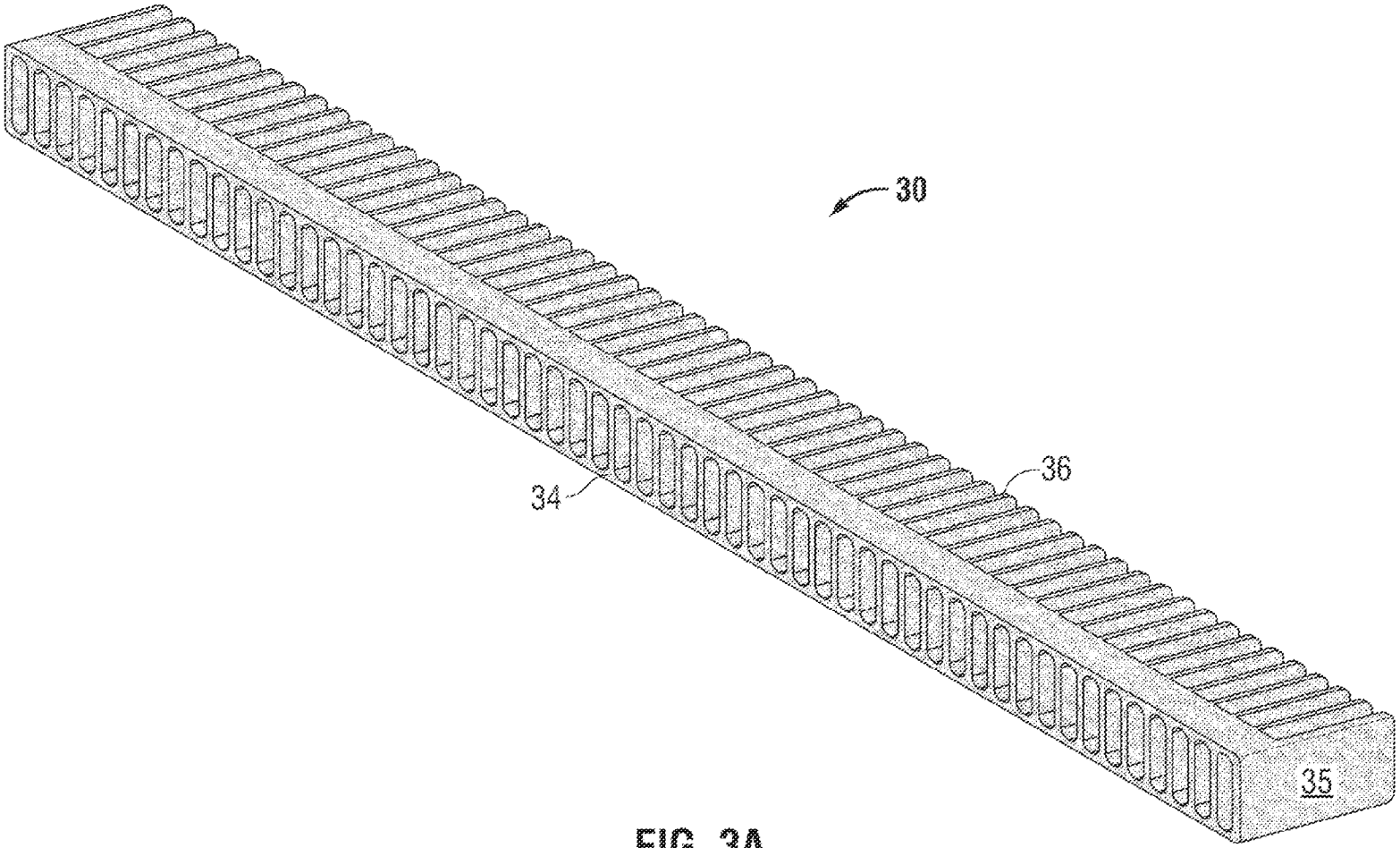
FIG. 3A depicts a monolithic collector-radiator structure that has been coated with a surface conditioning material, e.g., an ozone reducing material.
Figure 3B:
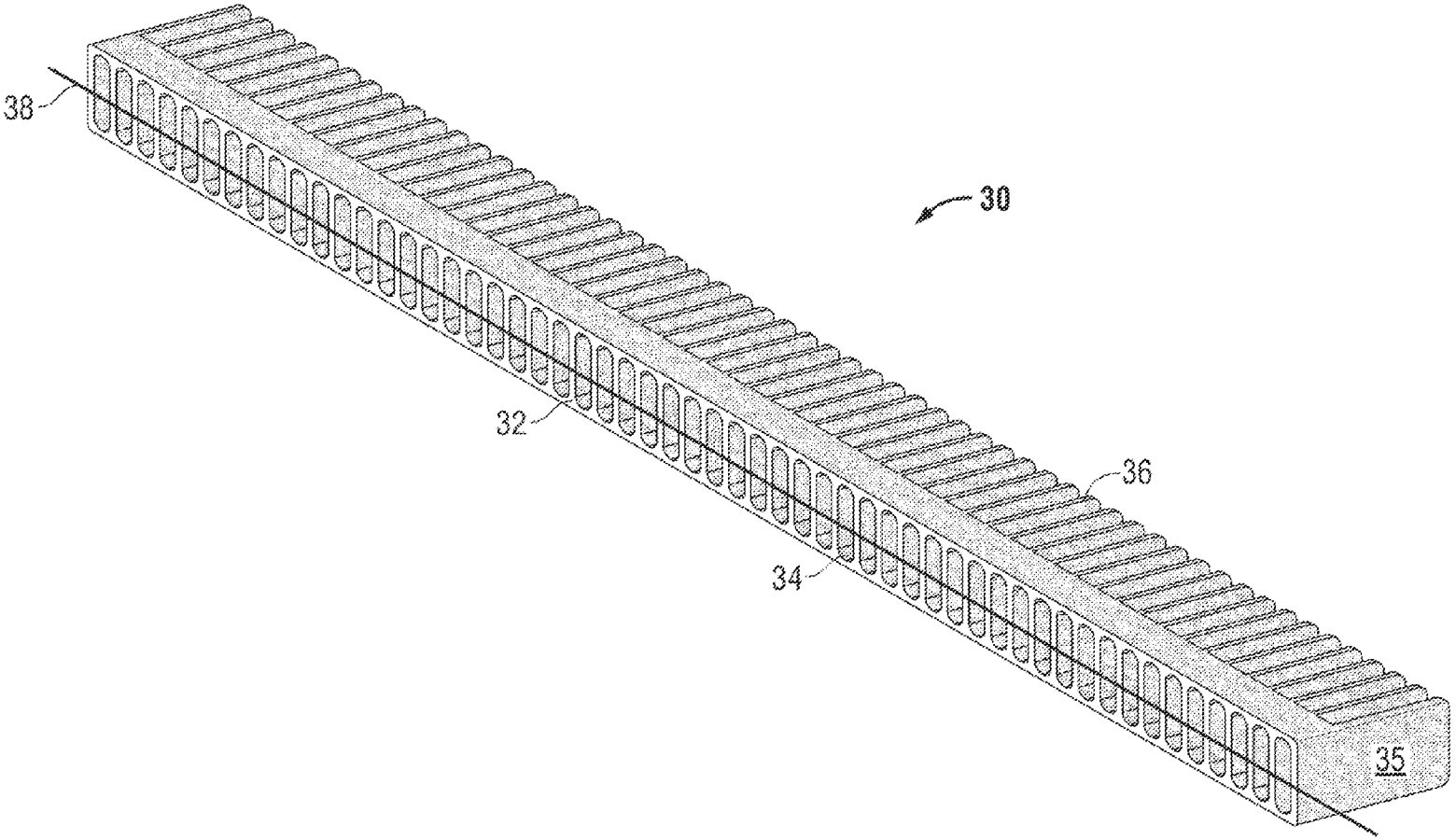
FIG. 3B depicts a monolithic collector-radiator structure that has been coated with an ozone reducing material, with a leading portion being substantially free of the ozone reducing material.

FIG. 3A illustrates a monolithic collector-radiator structure 30 that has been coated with an ozone reducing material 35. FIG. 3B illustrates the monolithic collector-radiator structure 30' in a thermal management assembly in which a corona discharge-type emitter electrode 38 is fixed proximate to leading collector surfaces 34' of the collector-radiator structure 30'. During operation, surfaces 34' are exposed to substantial ion current or bombardment. Surfaces 34' present a smooth, hard electroplated, anodized or alodized surface substantially devoid of ozone reducing material 35. In the configuration illustrated in FIG. 3B, the ozone reducing material 35 has been substantially removed from leading portions of collector surfaces 34', e.g., using an Acetone solution, to reveal an underlying smooth, hard electroplated, anodized or alodized surface.

As differentiated between FIGS. 3A and 3B, surface conditioning material 35 may be initially applied jointly to surfaces 34 and 36, and thereafter removed from surfaces 34 most prone to effects of electrode 38. In a particular application illustrated in FIG. 3B, it has been demonstrated that a $MnO_2$ catalyst binder may be readily dissolved in Acetone solutions to remove the $MnO_2$ ozone reducing material 35 from surface 34. Thus, in some monolithic embodiments, a wiping or brushing technique using solvents can be employed to remove a catalyst or other conditioning material 35 at the leading surfaces 32,34 of the collector-radiator structure 30, 30'.

While some conditioning materials may be used on leading surfaces 32, 34, it has been discovered that certain surface materials or treatments such as a textured catalyst coating can cause arcing or other performance degradation or possibly device failure. Accordingly, in some instances, it is desirable to remove or omit surface conditioning materials 35 from select surfaces.

In accordance with some embodiments of the present invention, the depictions illustrate surfaces or regions, including leading surfaces of a collector electrode (or electrodes), which are exposed to substantial ion current or bombardment and other surfaces or regions not substantially exposed and therefore amenable to use of a wide range of ozone reducing materials.

With reference to FIGS. 3A and 3B, collection surfaces 34 generally experience strong electrical fields and significant ion current making them prone both to arcing if the surfaces degrade and enhanced wear due to ion bombardment and resulting chemistry. In some applications, a limited subset of ozone destructive materials may be suitable for used on surfaces 34. In contrast, non-collection surfaces 36 that are substantially outside of the EHD active area may suitable use of a wider set of ozone reducing materials 35.

Figure 4:
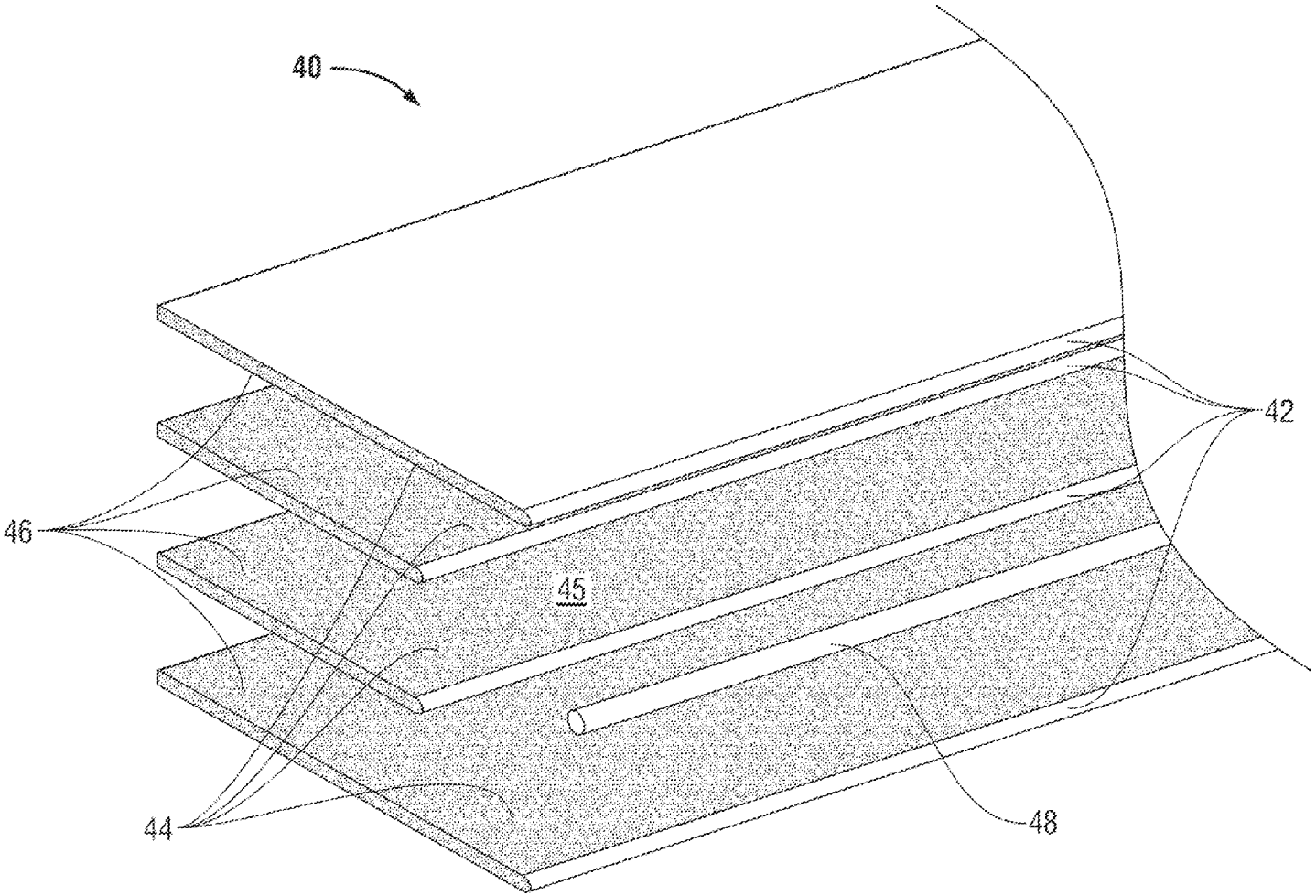
FIG. 4 illustrates an alternative collector-radiator structure oriented substantially parallel to the emitter electrode.

With reference to FIG. 4, collector-radiator structure 40 includes multiple collector-electrodes 44, e.g., planar fins, arranged substantially parallel to electrode 48. Front edges 42 of collector electrodes 44 can be arranged substantially equidistant from electrode 48, e.g., providing a substantially curved front profile when viewed from the side. Surfaces 46 are provided with surface conditioning 45 to provide ozone reducing and/or dendrite inhibiting properties or other surface properties described herein.

In some embodiments, a collector-radiator structure can include combinations of parallel and orthogonal collector surfaces.

With reference to FIGS. 5A-5D and 6A-6D, separate structures defining collector electrode surfaces 54, 54', 54" and radiator surfaces 56 are combined to form an integrated collector-radiator structure 50, 50', 50" and to likewise provide specialization of surface conditioning. Adjacent edges of surfaces 54 and 56 may be spaced apart, closely spaced, or even abutting depending on the application. Similarly, surfaces 54 and 56 may be of any size and geometry suitable to a given application to provide a desired degree of heat transfer, ion collection, and surface specific performance, e.g., ozone reduction.

Figure 5A:
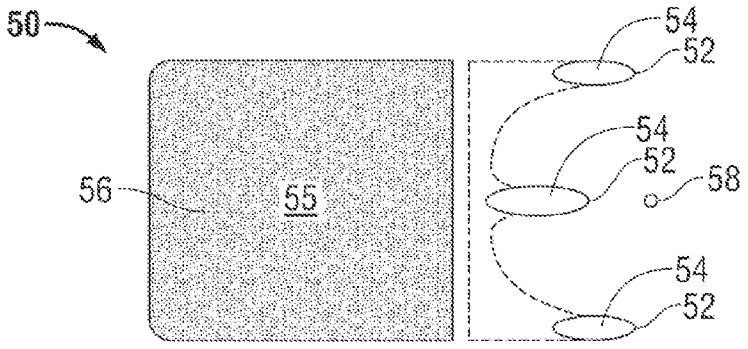
FIGS. 5A-5C and 6A-6C depict respective end-on and perspective views of illustrative integrated structures that combine separately formed collector and radiator structures for use in EHD fluid accelerators.
Figure 6A:
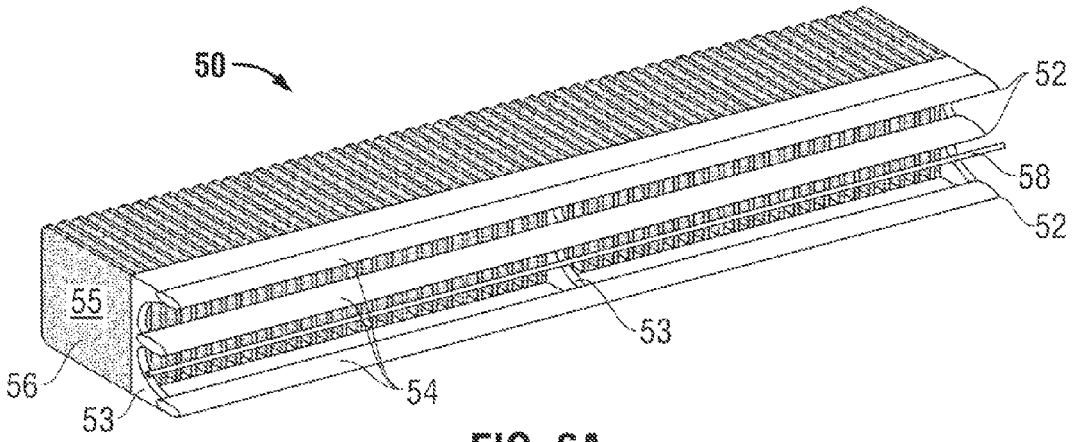

With reference to FIGS. 5A and 6A, leading edge collector surfaces 52 may comprise the bulk of collector surfaces 54 in cases where collector surfaces 54 are oriented substantially orthogonal to surfaces 56 along an array of surfaces 56. Collector surface supports 53 may be provided at intervals along collector electrode structure 50. In some embodiments, collector surfaces 54 are substantially parallel to electrode 58 while surfaces 56 are substantially perpendicular to electrode 58. Ions and surrounding air flow between electrode 58 and collector surfaces 54 when energized.

In some cases, electrode 58 may generate ozone and produce silica particulate that may accumulate in the form of dendrites on downstream surfaces. Accordingly, collector surfaces 54 may be provided with a first surface conditioning material selected to reduce adhesion of dendrites or other deleterious materials while surfaces 56 are provided with a different surface conditioning material 55 selected to reduce ozone.

Figure 5B:
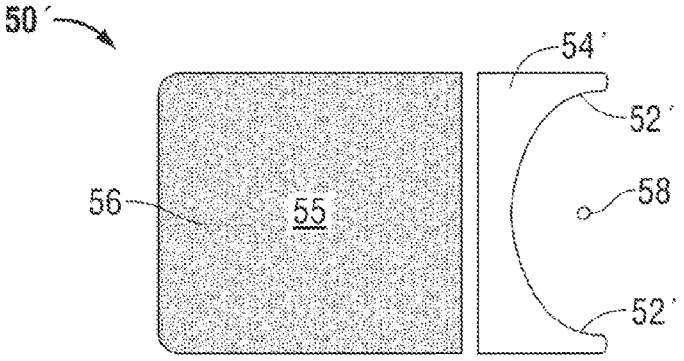
Figure 5C:
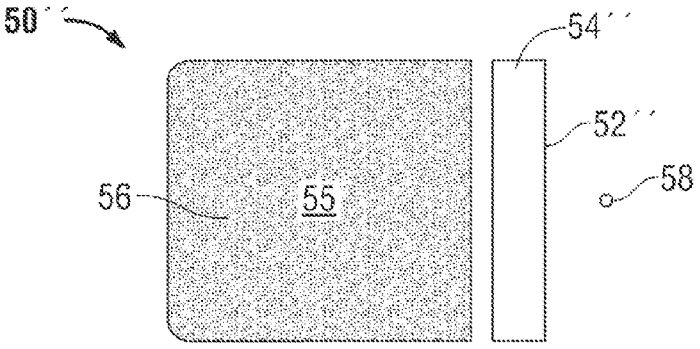
Figure 6B:
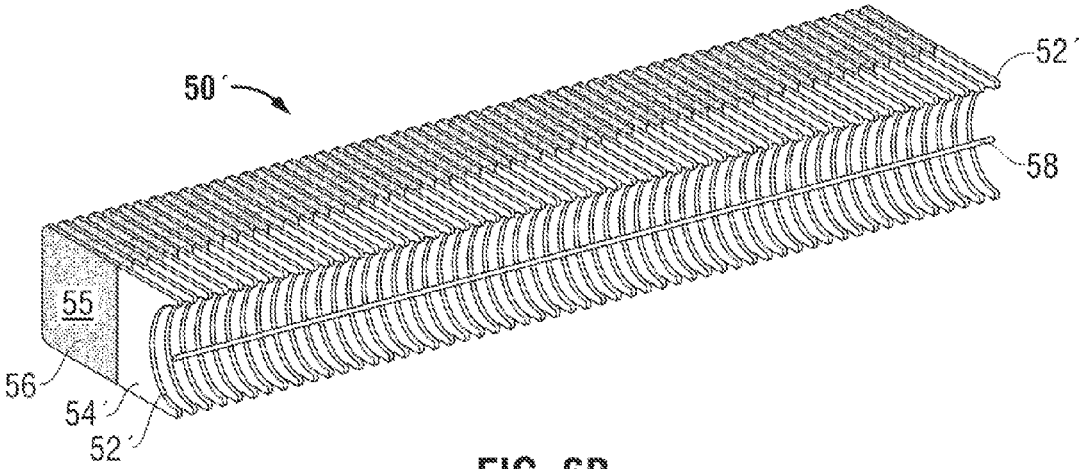
Figure 6C:
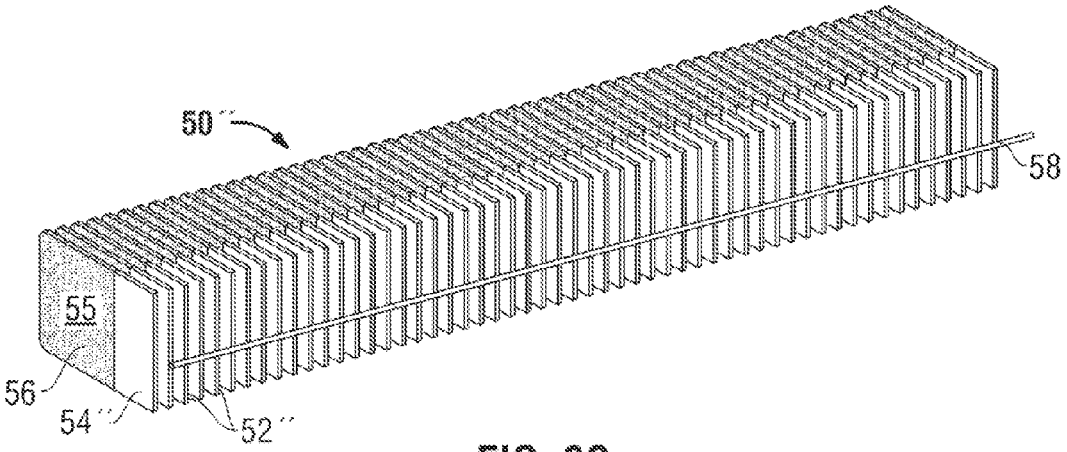

With reference to FIGS. 5B and 6B, collector surfaces 54' define a curved front edge 52 in spaced relation to electrode 58. With reference to FIGS. 5C and 6C, collector surfaces 54" may present a substantially linear front edge 52" to electrode 58. Collector surfaces 54', 54" may be arranged and spaced to provide desired fluid flow dynamics therebetween. In some cases, surfaces 54', 54" may be connected along a top and/or bottom edge by a support structure.

Figure 7:
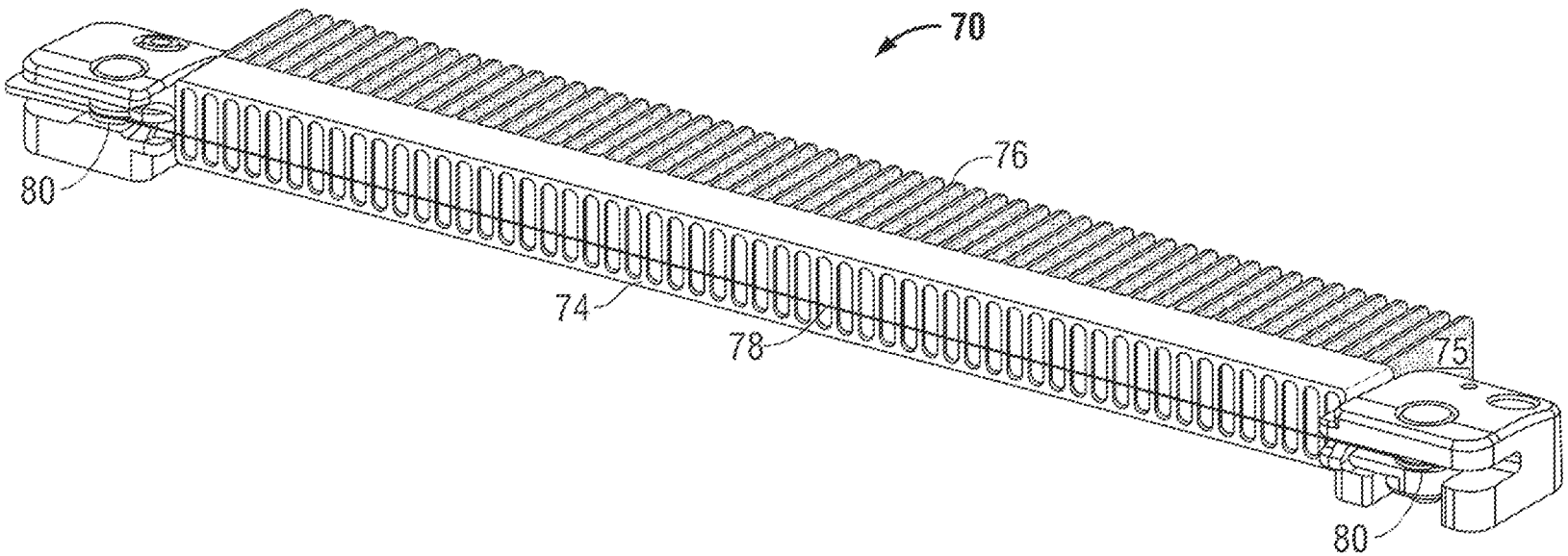
FIGS. 7 and 8 illustrate the respective collector-radiator structures of FIGS. 3B and 6A in a thermal management assembly in which a corona discharge-type emitter electrode is fixed proximate to leading collector surfaces of the collector-radiator structure that, during operation, are exposed to substantial ion current or bombardment and which present a smooth, hard electroplated, anodized or alodized surface substantially devoid of the ozone reducing material.
Figure 8:
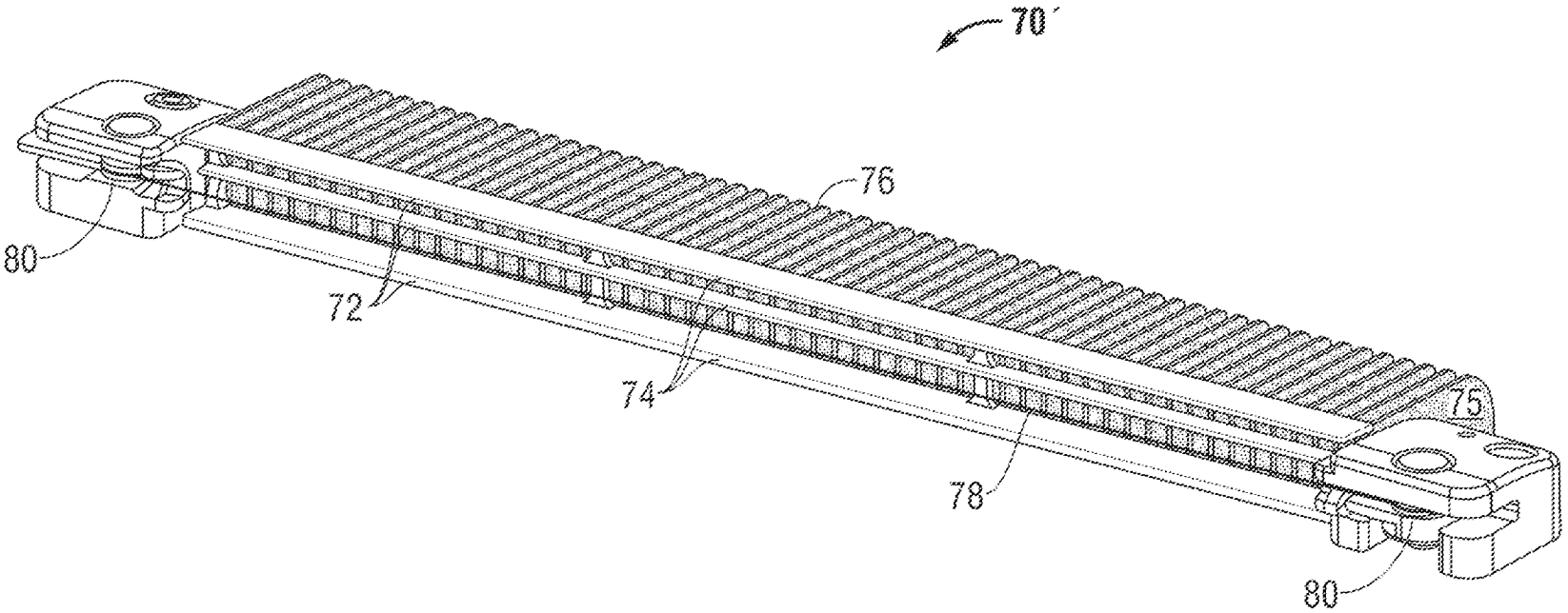

FIGS. 7 and 8 illustrate the respective collector-radiator structures 70, 70' similar to FIGS. 3B and 6A in a thermal management assembly in which a corona discharge-type emitter electrode 78 is fixed proximate to leading collector surfaces 74, 74' of the collector-radiator structure 70, 70' by support structures 80. Collector-radiator structure 70, 70' define leading surfaces 72, 72', 74, 74' exposed to substantial ion bombardment and other surfaces 76 not substantially exposed to ion bombardment.

Surfaces 74, 74' and 72, 72' may be conditioned in different manners than surfaces 76, 76'. More specifically, leading surfaces 74, 74' and 72, 72' may be conditioned to present a smooth equipotential surface in the presence of electric fields sufficient to cause corona discharge at emitter wire 78, while withstanding related ion bombardment and, in some cases, frictional cleaning. For example, surfaces 76 may be conditioned to provide ozone reducing capabilities, while leading surfaces 72, 72' of collector surfaces 74, 74' are substantially devoid of ozone reducing materials. In contrast, downstream heat transfer surfaces 76 of the collector-radiator structure 70, 70' not exposed to such ion bombardment are coated with ozone reducing material 75 that need not be so robust and, indeed, in some embodiments may include organic binders susceptible to degradation in such conditions. In some embodiments, surfaces 74, 74' present a smooth, hard electroplated, anodized or alodized surface substantially devoid of ozone reducing material 75.

In some embodiments, surfaces 76, 76' are defined on fins soldered or otherwise connected or arranged in an array on a heat pipe. In some cases, at least a portion of the heat pipe is provided with the same surface conditioning as surfaces 76, 76', e.g., with the same ozone reducing material and/or a second ozone reducing material.

While the forgoing represents a description of various implementations of the invention, it is to be understood that the claims below recite the features of the present invention, and that other implementations, not specifically described hereinabove, fall within the scope of the present invention. These and other embodiments will be understood with reference to the claims that follow.

What is claimed is:

1. An apparatus comprising:

an electrohydrodynamic fluid accelerator including an emitter electrode and leading surfaces of a collector electrode energizable to generate ions and to thereby motivate fluid flow along a flow path, wherein the leading surfaces are substantially exposed to ion bombardment; and heat transfer surfaces downstream of the emitter electrode along the flow path, the downstream heat transfer surfaces including at least a first portion not substantially exposed to the ion bombardment, wherein the first portion of the heat transfer surfaces is conditioned with a first ozone reducing material, and wherein the leading surfaces are not conditioned with the first ozone reducing material.

2. The apparatus of claim 1, wherein at least the leading surfaces are resistant to the ion-bombardment and to occasional arcing from the emitter electrode.

3. The apparatus of claim 2, wherein the leading surfaces are further robust to frictional cleaning.

4. The apparatus of claim 2, wherein the leading surfaces include a surface coating that is non-oxidizing at least in the presence of the motivated fluid.

5. The apparatus of claim 2, the leading surfaces further comprising a surface coating formed as one or more of:

an electroplate on injection-molded UL94-VO compliant thermoplastic;

an electroplate on die-cast zinc (Zn) or zinc alloy;

an electroplate on powder injection-molded metal; and an electroplate, anodization or alodization on die-cast aluminum (Al), aluminum alloy or magnesium (Mg) alloy.

6. The apparatus of claim 5, wherein the electroplate is formed as one or more of:

gold (Au) over nickel (Ni);

NiPd over Ni;

silver (Ag);

silver oxide ($Ag_2O$);

an oxide of manganese;

an ozone catalyst; and an ozone reactive material.

7. The apparatus of claim 1, wherein the leading surfaces are conditioned with a second ozone reducing material, different from the first.

8. The apparatus of claim 1, wherein the emitter electrode and leading surfaces of the collector electrode are energizable to establish a corona discharge therebetween; and wherein the ion bombardment results from the corona discharge.

9. The apparatus of claim 1, wherein the downstream heat transfer surfaces and the leading surfaces are constituent surfaces of a unitary structure that functions both as the collector electrode and as a heat sink.

10. The apparatus of claim 9, wherein the first ozone reducing material, if any, has been removed from the leading surfaces.

11. The apparatus of claim 9, wherein deposition, if any, of the first ozone reducing material has been masked from leading surfaces.

12. The apparatus of claim 9, wherein the downstream heat transfer surfaces and the leading surfaces are separately formed, but joined to form the unitary structure.

13. The apparatus of claim 1, wherein the heat transfer surfaces are distinct from the collector electrode, but proximate thereto in the flow path.

14. The apparatus of claim 13, wherein the collector electrode includes additional surfaces, other than the leading surfaces thereof, that are exposed to the fluid flow but not substantially exposed to the ion bombardment, wherein the additional surfaces of the collector electrode are also conditioned with the first ozone reducing material.

15. The apparatus of claim 13, wherein the collector electrode, including the leading surfaces thereof, has a surface coating electro-chemically robust to the ion-bombardment and to occasional arcing from the emitter electrode.

16. The apparatus of claim 15, wherein the electro-chemically robust surface coating is further robust to frictional cleaning of the leading surfaces.

17. The apparatus of claim 1, wherein the leading surfaces of the collector electrode are conditioned with a second ozone reducing material, different from the first.

18. The apparatus of claim 17, wherein the second ozone reducing material is selected from a group that includes:

gold (Au);

silver (Ag);

silver oxide ($Ag_2O$); and an oxide of manganese preparation without an organic binder susceptible to degradation in electric fields and ion bombardment conditions typical of corona discharge operation.

19. The apparatus of claim 1, wherein the first ozone reducing material is a catalyst is selected from a group that includes:

manganese dioxide (Mn02);

silver (Ag);

silver oxide ($Ag_2O$); and an oxide of nickel (Ni).

20. An apparatus comprising:

an electrohydrodynamic fluid accelerator including an emitter electrode and at least one collector electrode energizable to generate ions and to thereby motivate fluid flow along a flow path, the collector electrode coupled into a heat transfer pathway to dissipate heat into the fluid flow and including both leading surfaces substantially exposed to ion bombardment and additional surfaces not substantially exposed to the ion bombardment, wherein the additional surfaces, but not the leading surfaces, of the collector electrode are conditioned with a first ozone reducing material.

21. The apparatus of claim 20, wherein the leading surfaces include a surface coating electro-chemically robust to the ion-bombardment and to occasional arcing from the emitter electrode.

22. The apparatus of claim 21, wherein the electrohydrodynamic fluid accelerator is configured to establish corona discharge between the emitter and collector when energized to thereby generate the ions.

23. An apparatus comprising:

an electrohydrodynamic fluid accelerator including an emitter electrode and at least one collector electrode energizable to generate ions and to thereby motivate fluid flow along a flow path, the collector electrode including leading surfaces substantially exposed to ion bombardment from the emitter electrode; and heat transfer surfaces, distinct from the collector electrode, but proximate thereto, the heat transfer surfaces downstream of the emitter electrode in the flow path but not substantially exposed to the ion bombardment, wherein the heat transfer surfaces, but not the leading surfaces of the collector electrode, are conditioned with a first ozone reducing material.

24. The apparatus of claim 23, wherein at least the leading surfaces of the collector electrode include a surface coating electro-chemically robust to the ion bombardment and to occasional arcing from the emitter electrode.

25. The apparatus of claim 23, further comprising a heat pipe to which the heat transfer surfaces are thermally coupled, wherein the heat pipe is at least partially conditioned with at least one of the first ozone reducing material and a second ozone reducing material.

26. The apparatus of claim 23, further comprising:

a heat pipe to which the heat transfer surfaces are thermally coupled, wherein the heat pipe is at least partially conditioned with at least one of the first ozone reducing material and a second ozone reducing material.

* * * * *